US005979367A

United States Patent [19]

Aubry et al.

[11] Patent Number: 5,979,367

[45] Date of Patent: Nov. 9, 1999

[54] DENSE FLUIDIZED BED EXCHANGER TO BE ASSOCIATED WITH A CIRCULATING FLUIDIZED BED REACTOR

[75] Inventors: Jean Aubry, Le Plessis Robinson; Djamel Daoud, Paris; Alain Quaranta, Fontenay Les Briis, all of France

[73] Assignee: GEC Alsthom Stein Industrie, Velizy-Villacoublay, France

[21] Appl. No.: 09/038,972

[22] Filed: Mar. 12, 1998

[30] Foreign Application Priority Data

Mar. 31, 1997 [FR] France ..... 97 02991

[51] Int. Cl.[6] ..... B09B 3/00

[52] U.S. Cl. ..... 122/4 D; 122/235.12; 122/235.17; 122/235.22; 110/245

[58] Field of Search ..... 122/4 D, 235.12, 122/235.17, 235.22, 367.1; 110/245

[56] References Cited

U.S. PATENT DOCUMENTS 3,893,426 7/1975 Bryers .

4,173,950 11/1979 Waruasz .

FOREIGN PATENT DOCUMENTS

0477849A1 4/1992 European Pat. Off. .

*Primary Examiner*—Philip H. Leung
*Assistant Examiner*—Jiping Lu
*Attorney, Agent, or Firm*—Sughrue, Mion, Zinn, Macpeak & Seas, PLLC

[57] ABSTRACT

A dense fluidized bed exchanger includes a casing the vertical longitudinal walls of which consist of tubes conveying a heat-conducting fluid, the casing being divided lengthwise into chambers separated from each other by a baffle consisting of a wall consisting of tubes conveying a heat-conducting fluid. The vertical longitudinal walls consist of horizontal tubes and the baffle extends from the bottom wall of the casing to a height less than that of the latter and consists of superposed hairpin-shape transverse extensions of tubes of each of the vertical longitudinal walls disposed perpendicular to the tubes and extending to the opposite vertical longitudinal wall.

5 Claims, 3 Drawing Sheets

DENSE FLUIDIZED BED EXCHANGER TO BE ASSOCIATED WITH A CIRCULATING FLUIDIZED BED REACTOR

BACKGROUND OF THE INVENTION

1. Field of the Invention

The present invention concerns a dense fluidized bed exchanger associated with a circulating fluidized bed reactor.

It is more precisely concerned with a dense fluidized bed exchanger including a casing, the vertical longitudinal walls of which consist of tubes conveying a heat-conducting fluid, the casing being divided lengthwise into chambers separated from each other by a baffle consisting of tubes conveying a heat-conducting fluid.

2. Description of the Prior Art

An exchanger of the above kind is generally intended for use in a combustion installation comprising a circulating fluidized bed exchanger having a gas outlet leading into a separator cyclone. The solids recovered from the latter are treated in the dense fluidized bed before at least some of them are re-injected into the circulating fluidized bed exchanger.

A conventional dense fluidized bed exchanger includes a number of chambers in a casing:

- a solids receiving chamber into which solids are introduced via an orifice,
- at least one intermediate chamber into which the solids overflow after passing over a first baffle, and
- a solids outlet chamber receiving the solids after they pass over a second baffle and having a solids evacuation orifice.

The intermediate chamber is equipped with a bottom fluidizing air feed casing, fluidizing air injector nozzles on the bottom wall of the chamber and a heat exchanger generally consisting of a plurality of parallel arrangements of tubes conveying a heat-conducting fluid, for example steam, disposed transversely to the chamber and suspended from the top wall of the chamber, each arrangement of tubes being connected at the bottom to a heat-conducting fluid inlet manifold and at the top to a heated fluid outlet manifold.

Dense fluidization of the solids and recovery of heat by the exchanger therefore take place in this chamber.

Making the longitudinal walls of the casing and the baffles of tubes conveying a heat-conducting fluid for enhanced heat exchange, heat recovery and thus installation efficiency is known in the prior art.

In the prior art these baffles are walls of vertical tubes extending the full height of the casing and including windows distributed across their width at the required overflow height.

This overflow arrangement does not allow solids to overflow across the full width of the casing and because the windows must be of limited width, given the continuity of the vertical tubes from the bottom of the wall to its top, this arrangement does not allow continuous and optimal flow of the solids from one chamber to the other.

The present invention solves this problem by proposing a baffle arrangement consisting of tubes that can be made to a given height and thus allow continuous and undisturbed overflowing of the solids over the baffle.

SUMMARY OF THE INVENTION

To achieve this, in accordance with the invention, the vertical longitudinal walls consist of horizontal tubes and the baffle consists of superposed transverse hairpin-shape extensions of tubes of each of the vertical longitudinal walls, perpendicular to the tubes and extending to the opposite vertical longitudinal wall.

It is therefore possible to make a baffle of the required height.

In the preferred embodiment the extensions alternate vertically from one side to the other to procure mechanical stability and a balanced flow of the heat-conducting fluid.

To provide hydrostatic strength, the baffle consisting of a double tubed wall is preferably internally reinforced with bracing members.

In a preferred embodiment, alternate tubes of each vertical wall include an extension of the above kind directed towards the other wall and an extension of the other wall that is in the same horizontal plane as the tube of the other wall not having any extension, the alternate tubes being interleaved between two such extensions.

The top part of the baffle is advantageously chamfered with a reducing section.

The invention is described hereinafter in more detail with the aid of drawings showing a preferred embodiment of the invention.

DETAILED DESCRIPTION OF THE PREFERRED EMBODIMENT

Figure 1:
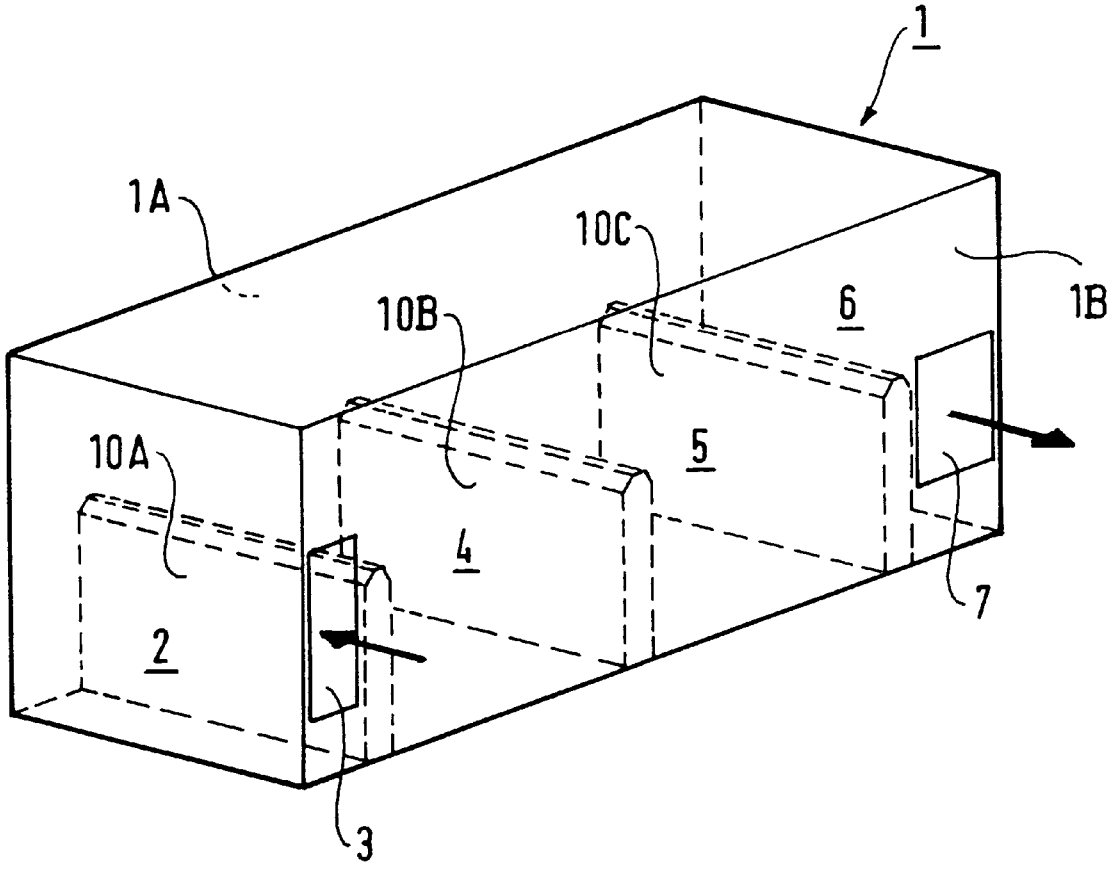
PRIOR ART FIG.1
FIG. 1 is a schematic perspective view of a conventional dense fluidized bed exchanger casing.

A conventional dense fluidized bed exchanger as shown diagrammatically in FIG. 1 includes a number of chambers inside a casing 1:

- a solids receiving chamber 2 into which solids are introduced via an orifice 3,
- at least one chamber 4, 5 into which the solids overflow after passing over a first baffle 10A and separated from each other by a baffle 10B of the same type, and
- a solids outlet chamber 6 receiving the solids after they have passed over another baffle 10C and including a solids evacuation orifice 7.

Figure 2:
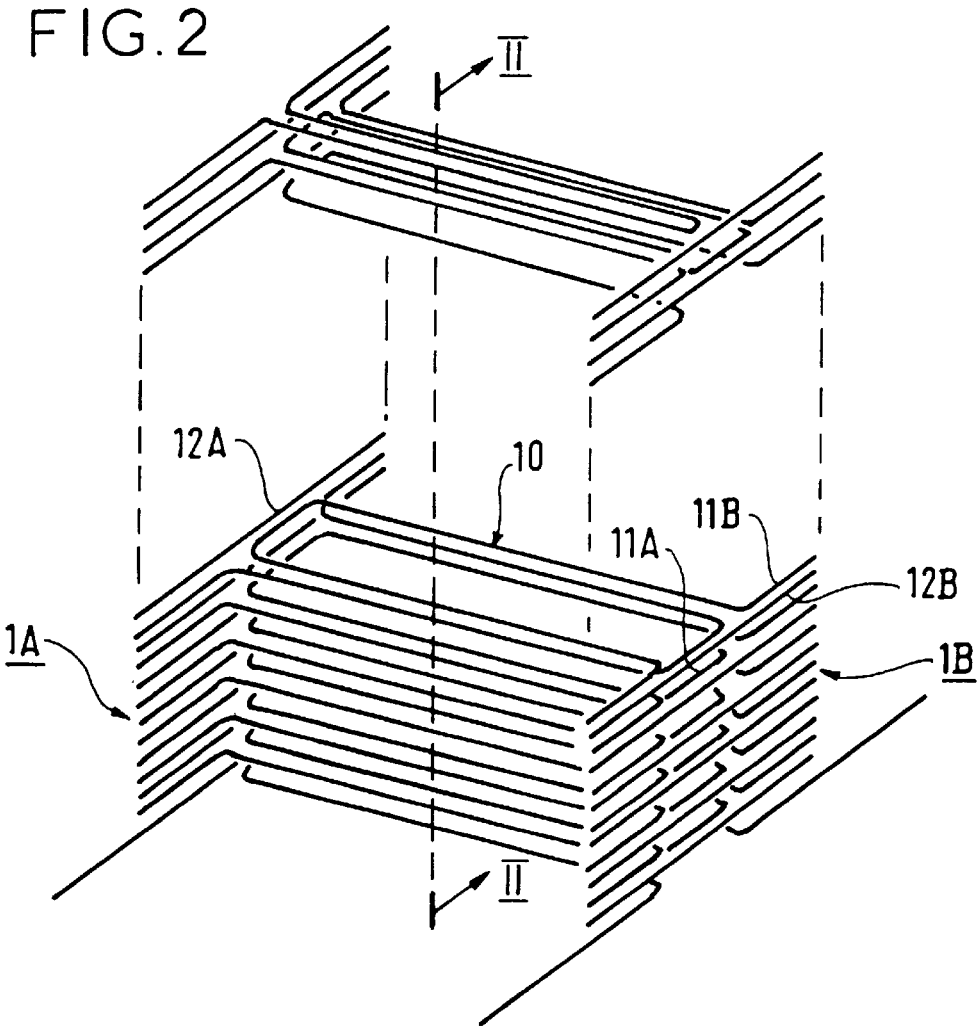
FIG. 2 is a detail perspective view of an exchanger in accordance with the invention.

As can be seen in FIG. 2, in accordance with the present invention, the vertical longitudinal walls 1A, 1B consist of horizontal tubes 11A, 12A and 11B, 12B.

The baffle 10 consists of superposed transverse hairpin-shape extensions of tubes 11A, 11B of each of the vertical longitudinal walls 1A, 1B perpendicular to said tubes and extending to the opposite vertical longitudinal wall 1B, 1A.

To be more precise, alternate tubes 11A, 11B of each vertical wall 1A, 1B include an extension of this kind directed towards the other wall 1B, 1A. An extension of the other wall 1B, 1A, is interleaved between two such extensions, and is in the same horizontal plane as the tube 12A, 12B of the other wall 1A, 1B that does not have any extension.

The top part of the baffle 10 is chamfered with a reducing section.

In this way a constant pitch between tubes is obtained, both in the vertical walls and in the baffle, without any intersection of tubes.

Figure 3:
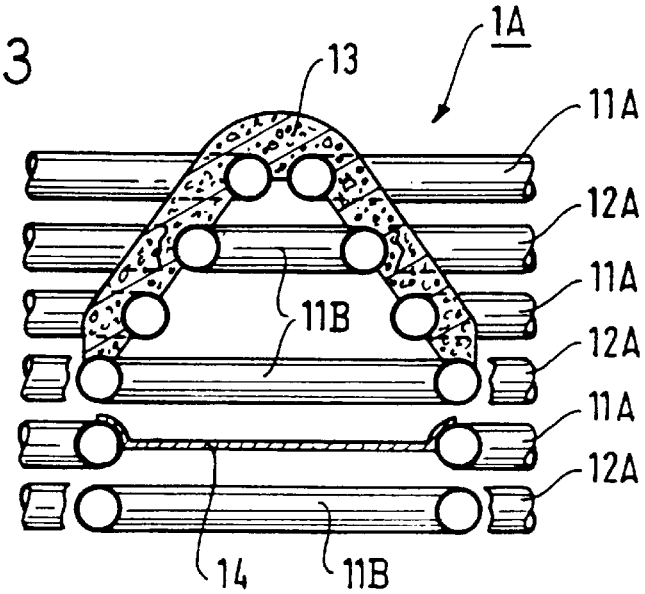
FIG. 3 is a part-sectional view taken along the line II—II in FIG. 2.

Conventional metal fins close the walls of tubes formed in this way, linking all the adjacent tubes, and the baffle is covered externally with a layer of concrete 13 (FIG. 3).

The tube structure is mechanically strengthened by bracing members disposed inside the baffle.

The top part of the baffle 10 is shown in cross-section in FIG. 3.

A top bracing member 14 is shown in FIG. 3. It is a bar welded between the two branches of the hairpin shape of an extension. Such bracing members 14 are distributed over the height of the top part and over the width of the baffle to obtain the required mechanical stability.

Figure 4:
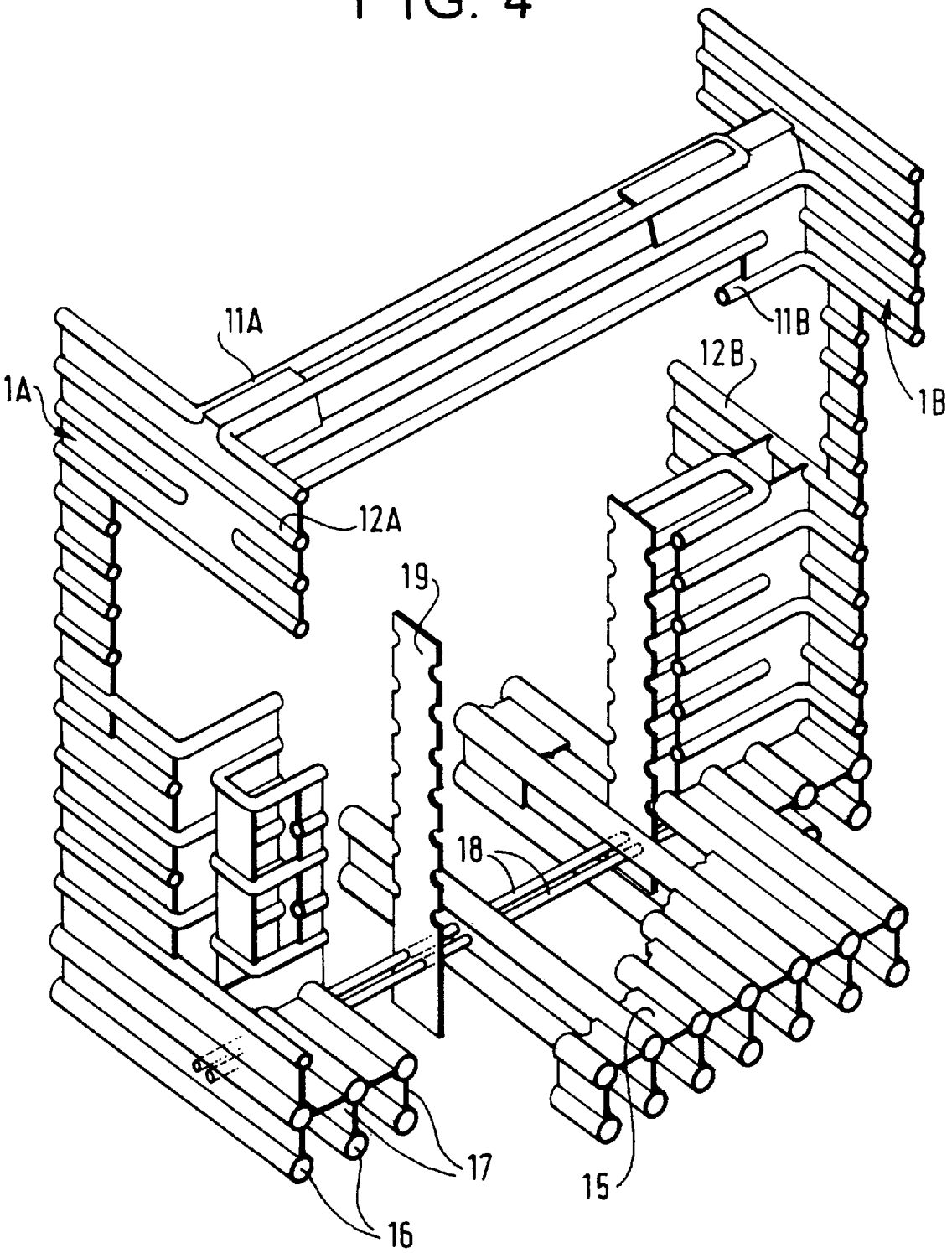
FIG. 4 is a partly cut away perspective view of an exchanger in accordance with the present invention.

As shown in FIG. 4, bracing members 19 distributed across the width of the bottom part of the baffle 10 provide mechanical stability and the connection to the bottom wall of the casing.

This bottom wall, also known as the sole plate, also comprises horizontal tubes, to be more precise a top wall 15 consisting of tubes linked by horizontal fins. Another tube 16 is connected to the bottom of each tube of this wall by a vertical fin 17. Two tie-rods 18 level with the baffle and longitudinal thereof are welded to the sole plate, passing through the vertical fins 17. The tie-rods 18 are connected to bracing members 19 having a maximal height equal to the height of the constant section part of the baffle and consisting of a plate or the like with lateral notches receiving the tubes of the extensions.

There is claimed:

1. A dense fluidized bed exchanger comprising:

a casing including:

a plurality of vertical longitudinal side walls, a top wall and a bottom wall, said walls comprising:

a plurality of horizontal tubes which convey a heat-conducting fluid;

wherein said casing is divided lengthwise into chambers separated from each other by at least one baffle, said baffle comprising:

a baffle wall including:

a plurality of baffle tubes conveying a heat-conducting fluid, wherein said baffle extends from said bottom wall of said casing to a height less than that of said casing at a top part of said baffle, said baffle further comprising:

superposed hairpin-shape transverse extensions of said baffle tubes of each of said walls disposed perpendicular to said horizontal tubes and extending to an opposite one of said walls.

2. The dense fluidized bed exchanger as claimed in claim 1, wherein said extensions alternate vertically from each of said walls to the opposite one of said walls.

3. The dense fluidized bed exchanger as claimed in claim 1, wherein said baffle wall is a doubled tubed wall which is reinforced internally with bracing members.

4. The dense fluidized bed exchanger as claimed in claim 2, wherein alternate horizontal tubes of each of said walls includes one of said extensions directed towards the opposite one of said walls, and another of said extensions of said opposite one of said walls is interleaved between two such extensions, is in a same horizontal plane as one of said horizontal tubes of said opposite one of said walls which does not include any of said extensions.

5. The dense fluidized bed exchanger as claimed in claim 1, wherein said top part of said baffle is chamfered with a reducing section.

* * * * *